US006903695B2

(12) United States Patent
Sjöblom et al.

(10) Patent No.: US 6,903,695 B2
(45) Date of Patent: Jun. 7, 2005

(54) ANTENNA DEVICE

(75) Inventors: Peter Sjöblom, Lund (CH); Vasilios Spiropoulos, Lund (CH)

(73) Assignee: Gigaant AB, Lund (SE)

( * ) Notice: Subject to any disclaimer, the term of this patent is extended or adjusted under 35 U.S.C. 154(b) by 0 days.

(21) Appl. No.: 10/450,325

(22) PCT Filed: Mar. 7, 2002

(86) PCT No.: PCT/SE02/00394

§ 371 (c)(1),
(2), (4) Date: Jun. 11, 2003

(87) PCT Pub. No.: WO02/073737

PCT Pub. Date: Sep. 19, 2002

(65) Prior Publication Data

US 2004/0027299 A1 Feb. 12, 2004

(30) Foreign Application Priority Data

Mar. 13, 2001 (SE) ..... 0100844

(51) Int. Cl.[7] ..... H01Q 1/24
(52) U.S. Cl. ..... 343/702; 343/906

(58) Field of Search ..... 343/702, 872, 343/873, 906; 455/89, 90.3

(56) References Cited

U.S. PATENT DOCUMENTS

| | | | | | |
|---|---|---|---|---|---|
| 5,164,737 | A | * | 11/1992 | Murray et al. | 343/702 |
| 5,606,732 | A | * | 2/1997 | Vignone, Sr. | 455/269 |
| 5,657,028 | A | * | 8/1997 | Sanad | 343/700 MS |
| 5,918,163 | A | * | 6/1999 | Rossi | 455/558 |
| 5,943,018 | A | * | 8/1999 | Miller | 343/702 |
| 6,169,521 | B1 | * | 1/2001 | Kitamura | 343/702 |
| 6,348,894 | B1 | * | 2/2002 | Lahti | 343/702 |

* cited by examiner

*Primary Examiner*—Tan Ho
(74) *Attorney, Agent, or Firm*—Bachman & LaPointe, P.C.

(57) ABSTRACT

An antenna device which is intended for mounting in a casing for an apparatus has a radiating element. The radiating element is manufactured from a conducting and resilient material, such as metal. A portion of the radiating element is surrounded by a piece of a configurationally stable, non-conducting material, such as plastic. The plastic piece is disposed for mounting of the antenna in the inside of the casing, preferably by snap action.

8 Claims, 2 Drawing Sheets

ANTENNA DEVICE

TECHNICAL FIELD

The present invention relates to an antenna device for mounting in a casing for an apparatus, the antenna having a radiating element which is manufactured from a conducting and resilient material such as metal.

BACKGROUND ART

Prior art apparatuses for wireless information transfer are, without exception, provided with antennas which are protracted a considerable distance outside the apparatus proper. Developments are now moving steadily in a direction towards the apparatuses' being provided with smaller antennas, and even antennas which are disposed on the circuit card of the apparatus. A new practical application where this has become particularly topical is the new standard "Bluetooth" for wireless transfer between, for example mobile telephones and computers.

In general, the antenna is connected to electronics which are mounted on a circuit card. In such instance, the electronics adapt the incoming signal to the remaining electronics. The antenna is generally mounted on the circuit card and, thereby, takes up quite a considerable amount of space on it. It happens that the antenna is mounted a few millimetres from the circuit card, but the distance between the circuit card and the antenna is then so slight that it is difficult or impossible to mount components on the area of the circuit card which is overlapped by the antenna.

At the same time, developments are moving towards electronic apparatuses' becoming steadily smaller and lighter, while being provided with an increasing number of functions and finesses. This greatly contributes in a shortage of space in the electronic apparatuses, not least on the circuit cards. Moreover, small dimensions of the components entails that the assembly, which cannot be fully automated, is becoming increasingly difficult.

Problem Structure

The present invention has for its object to realise an antenna which takes up a minimum surface area on the circuit card and, at the same time, is simple to mount in place.

Solution

The object forming the basis of the present invention will be attained if the antenna device intimated by way of introduction is given the characterising features that a portion of the radiating element is surrounded by a piece of a configurationally stable, non-conducting material such as plastic, and that this plastic piece is disposed for mounting of the antenna in the inside of the casing.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

Figure 1:
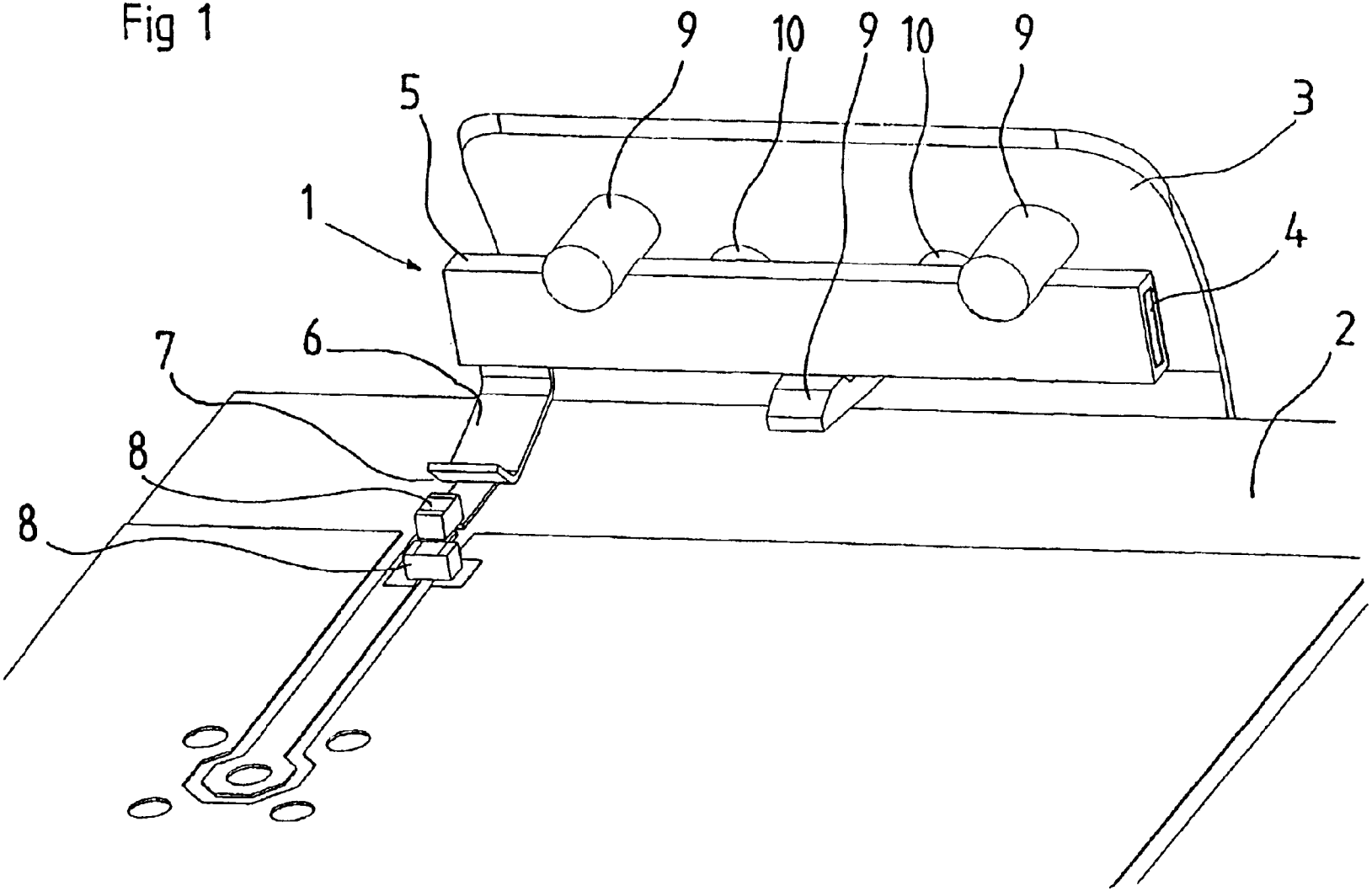
FIG. 1 is a perspective view of the antenna according to the present invention in the mounted state on the inside of the apparatus casing.

FIG. 1 shows an antenna 1 according to the present invention in its mounted state. The antenna 1 is in contact with a circuit card 2 and is mounted on the inside of an apparatus casing 3. The Figure shows only a small portion of the apparatus casing 3.

The antenna 1 has a radiating element 4 which is manufactured from a conducting material. Such a conducting material is advantageously a metal. The radiating element 4 is elongate and extends throughout practically the whole of the length of the antenna 1. The radiating element 4 is, at the same time, relatively thin in relation to its extent in the longitudinal direction and lateral directional, respectively, and is of such slight material thickness that it is hardly configurationally stable enough for its mounting in place.

Figure 2:
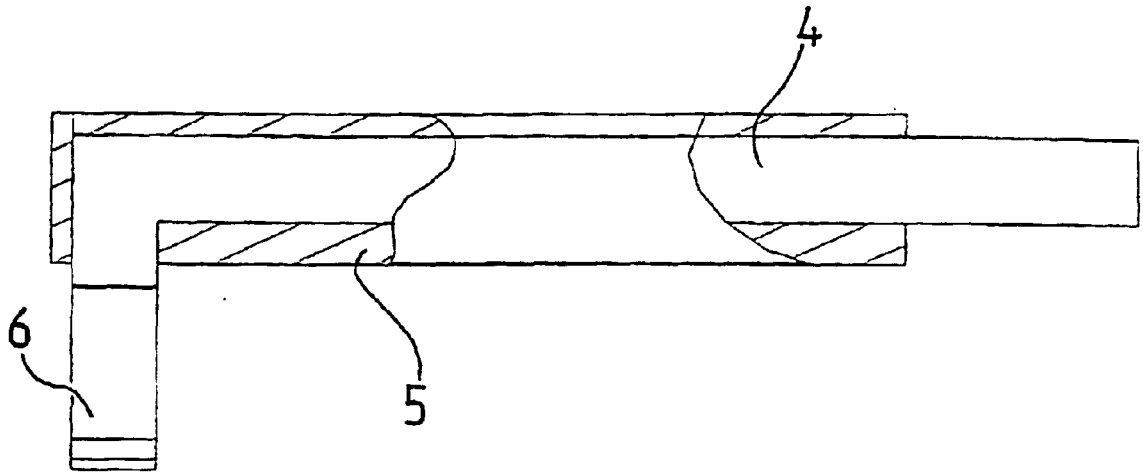
FIG. 2 is a view straight from the front of a partly cut-away antenna device according to the present invention.

FIG. 2 shows the antenna 1 straight from the front, the antenna 1 being partly cutaway. In this instance, it will be apparent that the radiating element 4 is substantially in the shape of an L. The radiating element 4 displays no marked directional effects, but radiation is transmitted and received in as good as all directions.

The radiating element 4 is surrounded by a piece 5 of a non-conducting material of good configurational stability which extends along the greater part of the length of the radiating element 4. Advantageously, the non-conducting material is a plastic and, in the construction, a plastic material is suitably selected in which the electromagnetic losses are low. The surrounding piece 5 of plastic modifies the electric length of the radiating element 4. With a correct selection of plastic material, the electric length increases in relation to what the radiating element 4 would otherwise have, and the antenna can, as a result, be given shorter physical length than would otherwise have been possible. Thus, the antenna 1 can be downscaled.

The plastic material should further be so hard that it can be handled without the risk of damage thereto and so that the antenna 1 can be mounted simply on the inside of the casing 3. Taking into account the assembly possibilities, it is desirable that the material is so tough and durable that it does not break apart on assembly.

Figure 3:
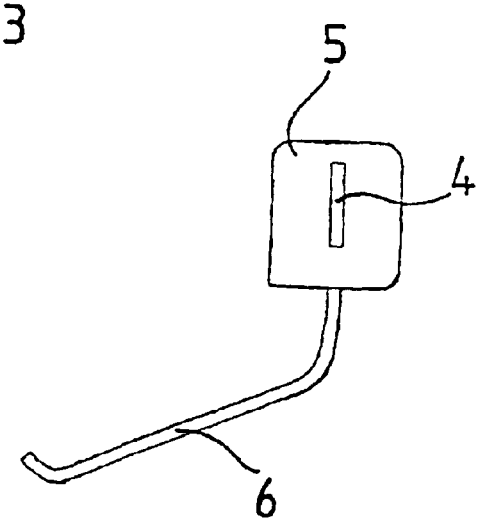
FIG. 3 is an end elevation of the antenna according to the present invention.

FIG. 3 shows the antenna straight from one end. In this instance, it will be apparent how the plastic piece 5 surrounds the radiating element 4 of metal. It is also clearly apparent from the same Figure that a contact finger 6 for contact with the circuit card extends away from the radiating element 4 and the surrounding plastic piece 5. The contact finger 6 is manufactured from a conducting material, preferably metal and, in the preferred embodiment, is of one piece manufacture with the radiating element 4.

The contact finger 6 is directed towards the circuit card 2 in its mounted state and is resilient so that its end portion is pressed against the circuit card with a certain spring force, which ensures the contact with the circuit card. At the same time, the contact finger 6 is of such extent in the vertical direction that the antenna can be placed a certain distance from the circuit card and be in contact with it in only a limited area at the end region of the contact finger 6.

More precisely, the contact finger 6 is in galvanic contact with the circuit card 2 in a discrete contact surface 7. This contact surface 7 is advantageously printed or etched on the circuit card 2 in the same manner as leads between different components which are disposed on the circuit card. From the contact surface 7, there are disposed leads to one or more matching components 8 for adapting the antenna to the electronics of the circuit card. No other components above and beyond the above-mentioned matching components 8 are shown in FIG. 1. It should be particularly noted in FIG. 1 that the antenna 1 is located a certain distance from the circuit card 2. The distance to the circuit card 2 is sufficiently large so as not to prevent the mounting of components thereon. In the preferred embodiment, the antenna 1 is moreover disposed at the side edge of the circuit card 2 and this also contributes to the fact that the surface of the circuit card 2 can be put to maximum use.

In manufacture, the radiating element 4 is surrounded by the plastic piece 5 preferably with the aid of injection moulding. In such instance, the radiating element 4 is placed in a moulding tool and projecting portions such as the contact finger 6 are fixedly clamped between the halves of the tool. If necessary, the moulding tool is also provided with moving jaws which fixedly clamp and stabilise the radiating element 4 between them. If moving jaws are employed, they leave holes or recesses after them in the finished plastic piece 5. However, such holes have only a marginal effect on the properties of the antenna 1. When the injected plastic has hardened, the antenna 1 is released from the tool.

As was mentioned above, the antenna 1 is secured on the inside of the apparatus casing 3. FIG. 1 shows a plurality of engagement members 9 which are provided for a snap engagement with the antenna 1. On the inside of the casing, there is also one or more spacer elements 10 in order further to keep the antenna 1 in place. The spacer elements 10 are somewhat shorter than the engagement members 9 so that the plastic piece 5 rests against the spacer element 10 at the same time as the engagement members 9 grasp in around the upper and lower edges of the plastic piece.

The antenna is principally intended for so-called "Bluetooth" applications, which implies that it functions for transfer in the band between 2.4 and 2.5 GHz. The antenna can therefore be disposed in both mobile telephones and computers and all other accessories to them.

Description of Alternative Embodiments

In the Figures, in particular FIGS. 1 and 2, it is shown how the radiating element 4 of the antenna 1 extends a distance outside the plastic piece 5. Fine tuning of the antenna 1 can therefore simply be put into effect, but such an adaptation is seldom relevant in mass production. The length of the radiating element 4 in relation to the length of the plastic piece 5 is, however, variable. It is fully possible to cause the plastic piece wholly to surround the radiating element 4. As a result, the radiating element 4 will not be visible from outside. The antenna 1 will also be less sensitive to damage during the assembly process.

The radiating element can also be given another design than the L-shape in the preferred embodiment. Such an example is an F-antenna, and in this application, the antenna has two contact points on the circuit card 2. Other forms of radiating elements are also possible and to the extent that they are fragile, they will be given protection by the plastic piece 5. Depending on the antenna type that is selected, the number and type of matching components will also be affected. For certain antenna types, no matching components are needed at all.

The method of securing the antenna 1 on the inside of the casing 3 may also be varied. For example, the engagement members 9 may be designed so that the antenna 1 is rather slid than snapped in place.

The securement in the casing 2 may also be varied so that the plastic piece 5 is provided with recesses for simple securement and cooperation with the engagement members 9 which may then be made smooth.

The present invention may be varied further without departing from the scope of the appended claims.

What is claimed is:

1. An antenna device (1) for mounting in a casing (3) for an apparatus, the antenna (1) comprising a radiating element (4) which is manufactured from a conducting and resilient material, wherein a portion of the radiating element (4) is surrounded by a piece (5) of a hard, non-conducting material, wherein piece (5) is disposed to be snapped in place in projections (9) on the inside of the casing (3).

2. The antenna device as claimed in claim 1, wherein the antenna (1) is provided with at least one resilient contact member (6) for contact with a circuit card (2).

3. The antenna device as claimed in claim 2, wherein the contact member (6) is of one piece manufacture with the radiating element (4) of the antenna (1).

4. The antenna device as claimed in claim 3, wherein the contact member (6) is disposed for contact with the circuit card (2) in a limited area (7).

5. The antenna device as claimed in claim 3, wherein the contact member (6) is disposed for contact with the circuit card (2) in a limited area (7).

6. An antenna device for mounting in a casing for an apparatus comprising:

a radiating element manufactured from a pliable and resilient conducting material, and a piece formed of a hard, non-conducting material surrounding at least a part of the radiating element for providing rigidity to the antenna device, the piece being configured for mounting the antenna device to spaced-apart engagement members in the casing.

7. The antenna device as claimed in claim 6, wherein the antenna (1) is provided with at least one resilient contact member (6) for contact with a circuit card (2).

8. The antenna device as claimed in claim 7, wherein the contact member (6) is of one piece manufacture with the radiating element (4) of the antenna (1).

* * * * *